United States Patent [19]

Darring

[11] 4,154,249

[45] May 15, 1979

[54] MIDRIFF CONTROLLING UNDERGARMENT

[76] Inventor: Violet L. Darring, 1437 Southern Ave., Apt. P-2, Oxon Hill, Md. 20032

[21] Appl. No.: 805,116

[22] Filed: Jun. 9, 1977

[51] Int. Cl.[2] ..... A41C 1/06

[52] U.S. Cl. ..... 128/438

[58] Field of Search ..... 128/430, 436, 443, 446, 128/427, 431, 428, 450, 433, 438; 2/70, 78 R

[56] References Cited

U.S. PATENT DOCUMENTS

| | | | |
|---|---|---|---|
| 1,407,390 | 2/1922 | Donaldson | 2/78 D |
| 2,033,505 | 3/1936 | Arons | 2/78 R |
| 2,587,911 | 3/1952 | Sider | 2/78 R |
| 2,715,732 | 8/1955 | Gamboni | 128/438 |

*Primary Examiner*—Werner H. Schroeder
*Assistant Examiner*—Doris L. Troutman

[57] ABSTRACT

A midriff controlling undergarment includes an upper torso encircling portion and a lower torso encircling pants portion releasably connected together at a parting plane located approximately at the waist of the user. A plurality of circumferentially spaced apart snaps are on the adjacent edges of the upper and lower portions, releasably joining them together in overlapping relationship to shape and control the waist of the user and prevent midriff bulge. The snaps enable easy, one-hand attachment and release of the two portions, thus facilitating use by obese persons or persons suffering from other infirmities, such as blindness and the like.

7 Claims, 4 Drawing Figures

MIDRIFF CONTROLLING UNDERGARMENT

BACKGROUND OF THE INVENTION

This invention relates generally to undergarments, and more particularly, to undergarments of the type which serve to shape and control the body of the wearer to prevent unsightly bulges of flesh and the like.

More specifically, the undergarment of the present invention is intended for use with stout or obese persons, although it may be equally as well used by other persons who require more firm support than provided by conventional undergarments.

Many types of undergarments are known in the prior art which are constructed to provide support to the user. For example, in U.S. Pat. Nos. 2,456,872 and 2,768,381 combined brassiere and girdle arrangements are disclosed wherein it is intended to control midriff bulge. In U.S. Pat. No. 2,456,872 the brassiere is of the type commonly referred to as a longline bra and is releasably connected to the top of the girdle by means of interengaging hooks on the lower edge of the brassiere and the upper edge of the girdle, respectively. U.S. Pat. No. 2,768,381 includes strap or band portions 22 which are folded or wrapped in opposite directions about the waist or midriff of the user in order to control midriff bulge. U.S. Pat. No. 2,587,911 also discloses an undergarment wherein a brassiere is releasably connected to a panty girdle. In this patent, a plurality of closely spaced snaps are provided on the lower edge of the brassiere and the upper edge of the panty girdle at the front portion of the garment.

All of these prior art devices serve their intended purpose to an extent, but each has one or more disadvantages. For example, U.S. Pat. No. 2,456,872 utilizes hooks and the hooks are difficult to manipulate with one hand. Moreover, the brassiere or upper portion of the garment in this patent comprises panels of inelastic material connected with selected panels of elastic material. Still further, the lower portion of the garment comprises a girdle and the user must wear an additional foundation garment or panties. U.S. Pat. No. 2,587,911 utilizes stays in its construction to assist in shaping and controlling the body. Moreover, a plurality of closely spaced snaps extend across the front only of the garment to releasably hold the brassiere and panty girdle together, and there are no interconnecting means on the sides or rear portion of the garment. This garment also includes inelastic panels.

The undergarment according to the present invention, on the other hand, includes a substantially one-piece annular or tubular elastic upper portion or brassiere and a substantially one-piece tubular elastic lower portion or pants releasably connected to the brassiere by means of a plurality of circumferentially spaced apart snaps secured to the adjacent edges of the upper and lower portions at reinforced areas of the garment, as defined, for example, by existing seams in the garment. Both the upper and lower portions are constructed substantially completely of elastic panels and the particular placement and arrangement of snap fasteners does not require extra flaps or extensions, as in some of the prior art devices. Moreover, the snap fasteners are spaced substantially completely around the garment, thereby providing interconnecting support not only at the front of the garment, but at the sides and back as well.

OBJECTS OF THE INVENTION

Accordingly, it is an object of this invention to provide an inexpensive, simple undergarment which comprises an upper portion and a lower portion releasably connected together by simple snap fasteners spaced completely around the garment to provide support and midriff control for the wearer.

Another object of the invention is to provide a foundation garment or undergarment constructed of relatively strong elastic material for shaping and controlling the body of the user, and wherein the garment includes an upper portion and a lower portion, with the upper and lower portions releasably connected together by means of snap fasteners spaced around the garment, whereby the snap fasteners may be readily located and manipulated with one hand, thus facilitating use thereof by obese persons or blind persons and the like.

A still further object of the invention is to provide a foundation garment or undergarment comprising body controlling panels of elastic material sewed together in a manner to define an upper portion and a separate lower portion with snap fasteners secured to the upper and lower portions at pre-existing reinforced points to thereby preclude the necessity of providing flap extensions or extra reinforcing means or the like for the fasteners.

DETAILED DESCRIPTION OF THE INVENTION

Figure 1:
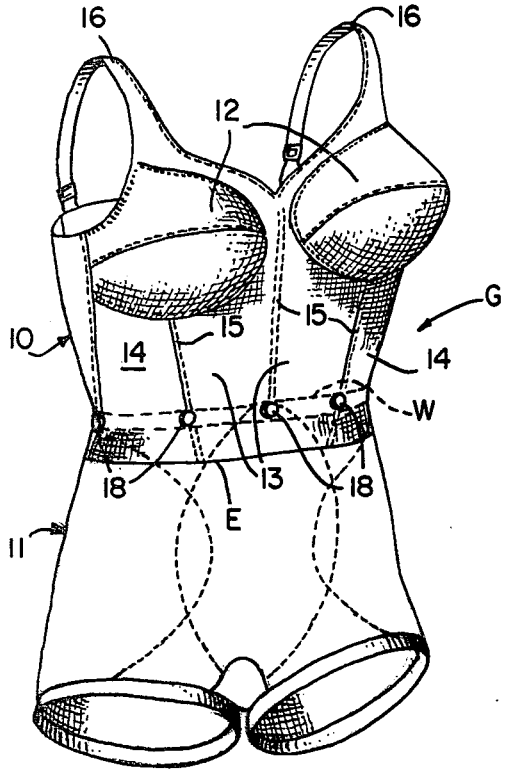
FIG. 1 is a front perspective view of a foundation garment in accordance with the invention, wherein the upper portion comprises a brassiere and the lower portion comprises a panty girdle.

In the drawings, wherein like reference numerals indicate like parts throughout the several views, a garment G in accordance with the first form of the invention and intended for use by a female person, comprises an upper portion 10 and a lower portion 11. The upper portion 10 comprises a longline brassiere and includes a pair of breast receiving cups or pockets 12 sewed in and to a plurality of elastic panels including a pair of front panels 13, side panels 14 and back panels 16. The panels are joined respectively at opposite side edges thereof by generally vertically extending seams 15. A pair of shoulder straps 16 are connected to the brassiere at the front and rear portions thereof in a conventional manner. The shoulder straps 16 include adjusting portions 17 for adjusting the length thereof to the particular user.

Figure 2:
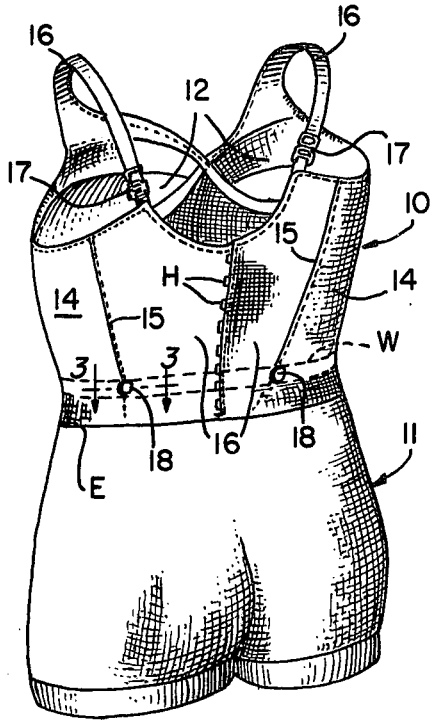
FIG. 2 is a rear perspective of the garment of FIG. 1.
Figure 3:
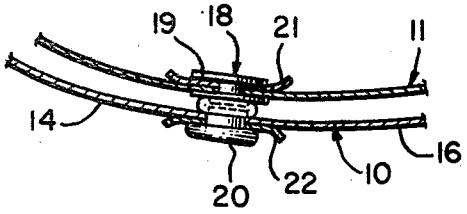
FIG. 3 is a greatly enlarged view in section taken along line 3—3 in FIG. 2.

A plurality of snap fasteners 18 are attached to the upper and lower portions 10 and 11, respectively, around the garment at a location approximately at the waist level of the wearer. As seen best in FIGS. 1 and 2, the snap fasteners 18 are attached to the upper portion 10 spaced upwardly from the lower edge E of the upper portion a distance sufficient to leave a substantial skirt portion and insure that the lower edge of the upper portion and the upper edge of the lower portion will overlap to prevent bulging of flesh between the upper and lower portions during use thereof. The snap fasteners are located at the upper edge of the lower portion. In FIG. 3, the snap fasteners are seen as comprising an inner male member 19 attached to the lower portion or panty girdle 11 and an outer female member 20 attached to the upper portion 10. If desired, small patches of reinforcement 21 and 22 may be associated with the respective parts of the snap fastener. Conventional hook fasteners or the like H may be provided on the brassiere in the back thereof.

In use, the center snap 18 in the front of the garment serves as a locating point for a blind person or the like, whereby the respective snap halves are associated with the correct snap half to insure proper alignment of the upper and lower portions of the garment. Moreover, by the construction herein described, it is readily apparent that the garment can be manufactured quite economically, and in fact, it is contemplated that relatively inexpensive garments of relatively conventional construction can be easily adapted to the invention and body control and shaping will be provided thereby equivalent, and in fact, superior to that obtained with much more expensive undergarments.

Figure 4:
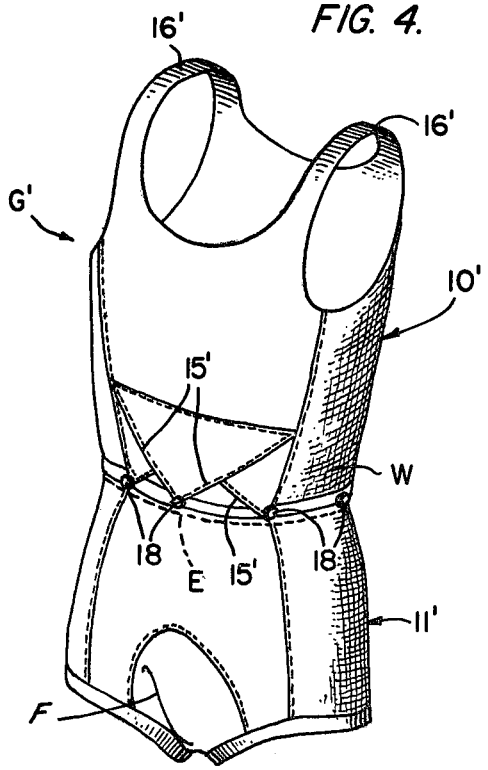
FIG. 4 is a front perspective view of a modification of the invention, wherein the foundation garment or undergarment comprises an upper portion and a lower portion consisting of briefs or pants for use by a male person.

A modification of the invention is indicated generally at G' in FIG. 4 and is generally similar to the form of the invention described and illustrated in connection with FIGS. 1–3, except that the garment G' is intended to be worn by a male person and to that extent, the upper body portion 10' does not include cups or breast receiving pockets 12. Instead, reinforcing and body supporting seams 15' are strategically placed in the upper portion 10', particularly at the front thereof, to provide desired support for the stomach of the wearer and the snap fasteners 18 are located at junctures of these seams 15', just as in the previous form of the invention. Thus, the upper and lower portions 10' and 11' may be easily snapped together by means of the snap fasteners 18 to provide control and shaping of the body of the wearer.

It is contemplated that the present invention will serve a distinct and advantageous purpose in replacing the difficult to wear and relatively expensive corsets and girdles commonly worn by persons either desiring or needing shaping and control of the body.

The provision of the snap fasteners 18 on the waistband W of the lower body pants portion and on the upper body portion spaced upwardly from the lower edge E thereof insures that the upper and lower body portions will remain in overlapped relation, as shown in the Figures, during use, and the wearer is enabled to stoop, sit or stretch without causing the upper and lower body portions to become separated, which would enable midriff bulge to occur.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims. Also, a slit is formed in the front of the lower portion 11', defining a fly F.

I claim:

1. An undergarment for shaping and providing support to the body of the wearer, comprises: A one-piece, generally tubular upper body portion having a lower edge and formed substantially completely of panels of elastic material sewed together along generally vertically extending seams; a one-piece, generally tubular lower body pants portion having an upper edge and formed substantially completely of panels of elastic material sewed together along generally vertically extending seams; and a plurality of spaced apart snap fasteners secured on the lower body pants portion at the upper edge thereof and on the upper body portion adjacent the lower edge thereof but spaced upwardly therefrom thereby leaving a substantial skirt portion to avoid bulging of the flesh of a person wearing the garment between the portions, said snap fasteners extending completely around the garment and each comprising a male half and a female half secured respectively to the body portions, said snap fastener halves attached to the body portions at the location of said seams; said garment, during use, being readily releasably snapped together at a location or parting plane substantially at the waist of the wearer and having the adjacent edges thereof overlapped completely around the waist of the wearer, with the lower edge of the upper body portion extending downwardly beyond the top of the lower body pants portion, thus providing support for the busy of the wearer and preventing midriff bulge.

2. An undergarment as in claim 1, wherein the female halves of the snap fasteners are secured to the upper body portion.

3. An undergarment as in claim 2, wherein the male halves of the snap fasteners are secured on the waistband of the lower body pants portion.

4. An undergarment as in claim 1, wherein the upper body portion comprises a brassiere.

5. An undergarment as in claim 4, wherein the lower body pants portion comprises a panty girdle.

6. An undergarment as in claim 1, wherein the upper body portion comprises a sleeveless undershirt for men having reinforcing panels in the front thereof for supporting and shaping the stomach of the wearer.

7. An undergarment as in claim 6, wherein the lower body pants portion comprises men's briefs.

* * * * *